United States Patent [19]

Iizuka et al.

[11] Patent Number: 4,976,563

[45] Date of Patent: Dec. 11, 1990

[54] CONTAINER TYPE TOILET IMPLEMENT WITH AIR ESCAPE PASSAGE

[75] Inventors: Shigeo Iizuka; Tadao Saito, both of Tokyo, Japan

[73] Assignee: Yoshino Kogyosho Co., Ltd., Japan

[21] Appl. No.: 189,759

[22] Filed: May 3, 1988

Related U.S. Application Data

[63] Continuation-in-part of Ser. No. 147,629, Jan. 27, 1988, Pat. No. 4,808,022, which is a continuation of Ser. No. 854,768, Apr. 23, 1986, abandoned.

[30] Foreign Application Priority Data

Jul. 11, 1985 [JP] Japan ..... 60-106417
Nov. 15, 1985 [JP] Japan ..... 60-176232

[51] Int. Cl.[5] ..... B43K 29/00

[52] U.S. Cl. ..... 401/176; 401/141; 401/150; 401/178

[58] Field of Search ..... 401/141, 146, 149–151, 401/176, 177, 179, 182, 171; 222/386–387

[56] References Cited

U.S. PATENT DOCUMENTS

| | | | |
|---|---|---|---|
| 519,223 | 5/1894 | Bailey . | |
| 699,778 | 5/1902 | Upham . | |
| 1,138,772 | 5/1915 | Matthews . | |
| 1,207,121 | 12/1916 | Zeidler . | |
| 1,348,681 | 8/1920 | Wright . | |
| 1,557,357 | 10/1925 | Gornell . | |
| 2,116,009 | 5/1938 | Brown . | |
| 2,293,211 | 8/1942 | Mureau . | |
| 2,623,231 | 12/1952 | Gutenstein . | |
| 3,140,695 | 7/1964 | Fehling et al. | 401/141 |
| 3,167,806 | 2/1965 | Hogan . | |
| 3,181,539 | 5/1965 | Aston . | |
| 3,351,074 | 11/1967 | Aston . | |
| 3,468,612 | 9/1969 | Cishek et al. . | |

(List continued on next page.)

FOREIGN PATENT DOCUMENTS

| | | |
|---|---|---|
| 165657 | 1/1954 | Australia . |
| 62059/65 | 2/1967 | Australia . |
| 440628 | 10/1973 | Australia . |
| 0123518 | 10/1984 | European Pat. Off. . |
| 199597 | 10/1986 | . |
| 2630569 | 1/1978 | Fed. Rep. of Germany . |
| 959036 | 3/1950 | France . |
| 2551636 | 9/1984 | France . |
| 552673 | 12/1956 | Italy . |
| 62-86111 | 6/1987 | Japan . |
| 63-52511 | 4/1988 | Japan . |
| 136990 | 8/1952 | Sweden . |
| 688891 | 3/1953 | United Kingdom . |
| 1562817 | 10/1976 | United Kingdom . |
| 2150424 | 7/1985 | United Kingdom . |

*Primary Examiner*—Richard J. Apley
*Assistant Examiner*—D. F. Crosby
*Attorney, Agent, or Firm*—Oliff & Berridge

[57] ABSTRACT

A container type toilet implement has a container, and a bottom cover provided liquidtightly and elevationally movable at the lower portion of the container, the bottom cover having air escape grooves. A cylinder is erected upward from a neck of the container. A suction is mounted in the lower portion of the cylinder. A piston is engaged at the lower portion thereof with the upper inside of the cylinder and disposed slidably telescopically in the cylinder. A spring member is disposed between the cylinder and the piston for urging the cylinder downwardly. An exhaust valve member has two elastic plates extending downwardly at a predetermined interval from an upper end cylindrical portion formed in the piston, the elastic plate having opposed bent parts in a ring shape substantially at the intermediate thereof. A rod valve is disposed below the exhaust valve member, and an exhaust valve body is formed at the lower portion of the elastic plate of the exhaust valve member. A valve seat is formed at the central inner surface of the piston, and a sealing mechanism is provided for sealing the interior of the cylinder. A brush tip is disposed at the top of the exhaust valve member. The container type toilet implement prevents the liquid lotion in the container from leaking. Further, the bottom cover is provided with air escape grooves for eliminating air trapped in the container between the lotion and the bottom cover.

14 Claims, 4 Drawing Sheets

U.S. PATENT DOCUMENTS

| | | | |
|---|---|---|---|
| 3,889,684 | 6/1975 | Lebold | 128/402 |
| 4,033,700 | 7/1977 | Spatz . | |
| 4,309,119 | 1/1982 | Wittersheim . | |
| 4,405,249 | 9/1983 | Scales | 401/176 |
| 4,433,799 | 2/1984 | Corsette . | |
| 4,527,566 | 7/1985 | Abare | 128/402 |
| 4,580,408 | 4/1986 | Stuebner | 62/259.3 |
| 4,628,932 | 12/1986 | Tampa | 128/402 |
| 4,655,690 | 4/1987 | Boedecker et al. . | |
| 4,688,572 | 8/1987 | Hubbard et al. | 128/402 |
| 4,776,717 | 10/1988 | Iizuka et al. . | |
| 4,808,022 | 2/1989 | Iizuka et al. | 401/176 |
| 4,852,772 | 8/1989 | Ennis, III | 222/386 |

CONTAINER TYPE TOILET IMPLEMENT WITH AIR ESCAPE PASSAGE

BACKGROUND OF THE INVENTION

This application is a continuation-in-part of U.S. application Ser. No. 147,629 filed Jan. 27, 1988, now U.S. Pat. No. 4,808,022 issued Feb. 28, 1989, which in turn is a continuation of U.S. application Ser. No. 854,768 filed Apr. 23, 1986 now abandoned.

This invention relates to a container type toilet implement for containing a liquid toilet article such as, for example, an eyebrow pencil, a liquid lipstick or rouge. The container supplies the liquid article to the tip of a brush provided at the end of the container by operating a cylinder and piston mechanism provided in the container. The inventive container has an air escape passage to eliminate air in the container so that air bubbles do not exist in or contaminate the liquid article.

A conventional toilet implement using liquid toilet lotion is constructed with a cap having an integral brush tip retaining shaft. The cap clamps onto a container for the liquid toilet lotion to seal the container and impregnate the brush tip with the lotion in the container. Thus, when making up a face, the cap is removed from the container, and used as a handle or grasping member, and the lotion impregnated at the brush tip is coated on the face.

In the conventional toilet implement described above, when the brush tip is impregnated with the liquid lotion, it is necessary to insert the tip into the container for every makeup operation thereby causing the application of the makeup to be complicated. Further, when the cap is removed the container may be overturned to leak the lotion from the container. Also, since the quantity of the liquid toilet lotion impregnated on the brush tip is not constant, a liquid droplet tends to fall from the brush tip.

In addition, air may enter into the conventional implement to contaminate the liquid. The air may also result in air bubbles within the liquid on the brush tip, thus complicating the makeup application.

Piston/cylinder mechanisms in liquid applicators are known, e.g., see U.S. Pat. No. 3,351,074. Such mechanisms may dispense liquid from a container. However, air may be introduced into the container when sealing the container, the air contaminating the liquid within the container. Further, the air can only escape the sealed container by passing through the piston/cylinder mechanism, thereby causing air bubbles in the applied liquid. Air bubbles are undesirable from an application standpoint since they displace the volume of liquid product to be dispensed resulting in an irregular amount of applied product.

SUMMARY OF THE INVENTION

Accordingly, it is an object of this invention to provide a container type toilet implement which can eliminate the above-mentioned disadvantages of the conventional toilet implement and can supply a constant quantity of toilet lotion to the brush tip without air bubbles.

According to this invention, there is provided a container type toilet implement which comprises a container body formed liquidtightly with an elevationally movable bottom cover, and a cylinder and piston mechanism projected upwardly from a neck of the container for supplying lotion to a brush tip, thereby eliminating the possibility of leaking the lotion upon overturning the container. The bottom cover is provided with an air escape passage to permit escape of air trapped upon assembly of the device.

BRIEF DESCRIPTION OF THE DRAWINGS

The foregoing object and others will become more fully apparent upon reading the following description and the appended claims when read in conjunction with the accompanying drawings, wherein:

DETAILED DESCRIPTION OF THE PREFERRED EMBODIMENTS

Figure 1:
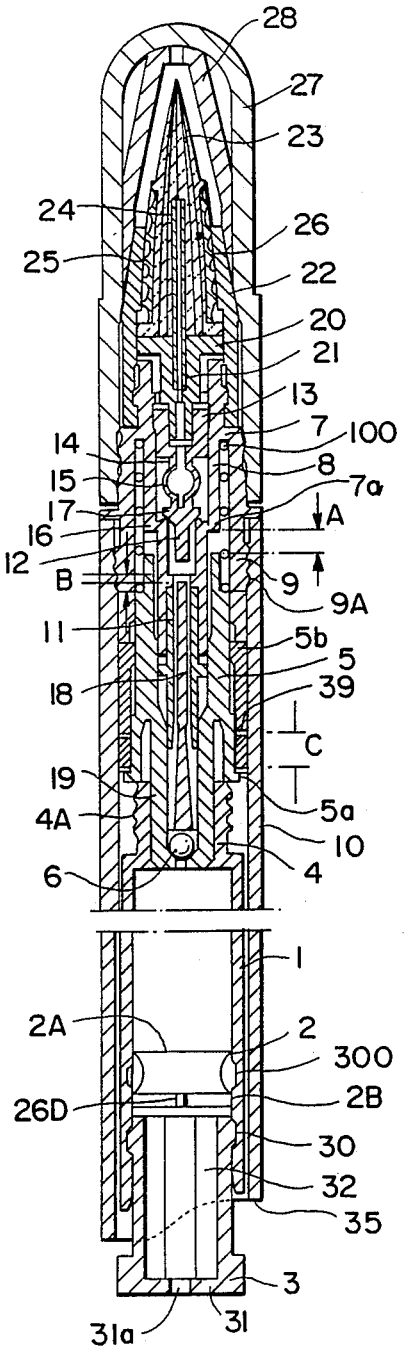
FIG. 1 is a longitudinal fragmentary sectional view of a first embodiment of a container type toilet implement according to this invention.

FIG. 1 illustrates a first embodiment of a container type toilet implement according to this invention. The container type toilet implement of this invention comprises a container 1 for containing liquid toilet article, and an elevationally movable bottom cover 2 liquidtightly sealing the bottom of the container 1. A button 3 is engaged with the lower end of the container to press the bottom cover 2 upwardly. A neck 4 extends from the container 1 and includes external threads 4A.

A cylinder 5 projects upwardly from the neck 4 of the container 1, and is engaged within the neck 4 so as to elevationally move upwardly and downwardly integrally with the container 1. A suction valve 6 is engaged in the lower portion of the cylinder 5, and a piston 7 formed substantially in an inverted U shape is telescoped within the upper portion of the cylinder 5.

The piston 7 has a double cylindrical structure of inverted U shaped section as described above with inner and outer cylinders 8,9. The lower outer periphery of the outer cylinder 9 is engaged via threads 9A with an upper portion of an external cylinder 10 located on the outer periphery of the container 1. A step 7*a* for controlling the upward movement of the cylinder 5 is formed on the inner cylinder 8 of the piston 7. Further, a sealing member 11 is hermetically and fixedly secured to the lower portion of the inner cylinder 8 of the piston 7, but does not prevent the cylinder from sliding. Thus, the sealing member 11 can prevent the liquid toilet article in the container from leaking externally of the cylinder when the suction valve 6 is opened.

An exhaust valve member 12 is disposed at the upper inside of the inner cylinder 8 of the piston 7, and is fixedly secured to the inner surface of the piston 7 by the top cylindrical portion 13. Two elastic plates 14 extend downwardly at a predetermiend interval from the lower surface of the cylindrical portion 13, and a bent portion 15 is formed at the intermediate area of the plates 14 in an opposed manner to form a ring-like shape. Further, an outward flange-shaped valved body 17 is formed on the lower part of the bent portion 15. The valve body 7 contacts under pressure a projecting valve seat 16 formed on the central inner surface of the inner cylinder 8 of the piston 7. A valve rod 18 is disposed at a predetermined interval B below the valve member 12, and is secured fixedly at the lower part thereof through a liquid passage 19 onto the lower inner periphery of the cylinder 5. A cylindrical member 21 having a flange 20 projected at the upper end outwardly is engaged fixedly within the cylindrical portion 13 of the valve member 12. A brush tip retaining shaft 22 with a converging shape at its end is detachably engaged with the upper end of the piston 7.

A brush tip 23 is mounted on the shaft 22, and is formed at the lower end in a flange solidified by an adhesive or thermal fusion-bonding to be engaged on the flange 20 of the cylindrical member 21. A hollow cylindrical core 24 for guiding the liquid toilet article or lotion to the brush tip is disposed in the vicinity of the inner center of the tip 23, and the lower end of the core 24 is engaged within the cylindrical member 21 to communicate with the valve member 12.

A metallic cylinder 25 is coated on the lower outer half periphery of the tip 23, and a rubber cylinder 26 is engaged between the cylinder 25 and the shaft 22. The cylindrical core 24, the metallic cylinder 25 and the rubber cylinder 26 are disposed at the ends so that the core 24 is disposed at the tip side from the metallic cylinder 25 and the rubber cylinder 26 is disposed further at the end of the tip 24 from the core 24.

A cap 27 is engaged with the outside of the tip retaining shaft 22, and is constructed to be engaged with the outer periphery of the outer cylinder 9 of the piston 7. Further, an inner cap 28 is engaged fixedly within the cap 27 so that its inner peripheral end is sealingly engaged with the outer periphery of the end of the tip retaining shaft 22, thereby preventing the brush tip from drying.

Figure 2A:
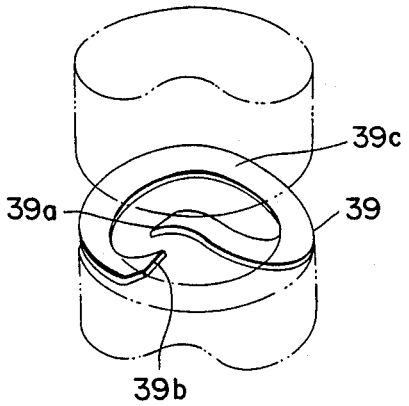
FIGS. 2(*a*) and 2(*b*) are perspective views of a sound producing mechanism employed in the toilet implement.
Figure 2B:
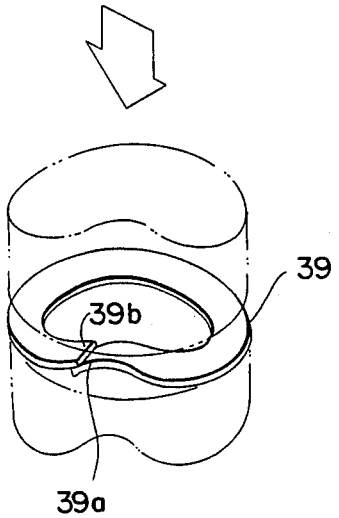

A sound producing mechanism 39 is provided to announce the fact that the pushbutton 3 lifts the cylinder 5 and the container 1 a predetermined distance. The sound producing mechanism is disposed between the flange **5*a* projected outwardly from the cylinder 5 and the supporting member 5*b* disposed at a predetermined interval C above the flange 5*a* outside the cylinder 5. The mechanism 39 is formed, as shown in FIGS. 2(*a*) and 2(*b*), with a wavy ring-shaped leaf spring 39*c* partly cut so that one cut end 39*a* is slightly superposed on the other cut end 39*b* of the leaf spring 39*c*. Thus, when the cylinder 5 moves upward, the leaf spring 39*c* is compressed between the flange 5*a* and the member 5*b*, the upper end 39*a* thereafter overrides the lower end 39*b* by the elasticity, whereupon a clicking sound is produced. The interval C between the flange 5*a* and the member 5*b* is formed to be substantially equal to the interval A between the end of the cylinder 5 and the step 7*a* of the piston 7. In other words, when the end of the cylinder 5 makes contact with the step of the piston 7, the sound producing mechanism 39** produces a sound.

As described above, when the liquid toilet lotion is supplied by the cylinder and piston mechanism to the brush tip, it is necessary that the liquid lotion should be already filled to the end of the hollow cylindrical core of the brush tip at first use. However, when the toilet implement of the construction described above is assembled, it is difficult to supply the liquid lotion to the end of the hollow cylindrical core, and the lotion is filled only in the container 1. Thus, the liquid lotion is not filled to the upper portion of the cylinder. In this state, even if the cylinder and piston mechanism is operated, the lotion cannot be supplied to the brush tip.

The following feature is provided to eliminate this inconvenience. The pushbutton 3 is engaged at the lower portion of the container 1 with a first engaging groove 30 formed near the lower end of the container 1, and a pressing head 31 projects from the outer cylinder. The pressing head 31 has a through-hole 31A which is an air passage to the outside of the container 1. Further, a shaft 32 is formed in the vicinity of the center of the pushbutton 3, and extends to the bottom cover 2 so that when the pushbutton 3 is depressed, the cover 2 is moved upward. In addition, a second engaging groove 300 is formed above the first engaging groove 30 of the container 1 to engage the pushbutton 3. The cover 2 is formed at its peripheral edge with an arcuate-shaped sectional elastic peripheral wall, which is pressed against the inner surface of the container 1 to seal the container but permit longitudinal movement with the container. A notch 35 is formed at one side on a lower end of the cylinder 9, and the pushbutton 3 is constructed to be depressed by means of the notch 35.

In the construction described above, when the pushbutton 3 is depressed before the first use of the toilet implement of this invention, the container 1, the cylinder 5 and the valve rod 18 move upward integrally. However, from the relationship of the interval B being smaller than the interval A, the valve rod 18 presses the valve member 12 to open the valve body 17. Further, the cylinder 5 contacts the step **7*a* of the piston 7 at the end of its movement to stop upward movement of the cylinder 5, the valve rod 18 and the container 1. When the pushbutton 3 is further depressed until it engages the second engaging groove 300, the bottom cover 2 is lifted upwardly by the movement of the pushbutton 3, and the suction valve 6** is opened by the pressure of the lotion in the container, so that the toilet lotion is filled from the container through the valve member to the end of the hollow cylindrical core.

The operation of the container type toilet implement having the construction described above will now be described. The toilet lotion is initially filled to the top in the cylinder 5 by the operation of the pushbutton 3. Then, to make up a face, the pushbutton 3 is pressed to lift the unit of the container 1, the cylinder 5 and the valve rod 18 (all of which are interconnected) against a return spring 100. This operation causes the volume of the cylinder 5 to decrease in response to movement of the cylinder 5 and valve rod 18, thus pressurizing the lotion in the cylinder. Since the upper end of the valve rod lifts the bottom end of the exhaust valve member, the lower portions of the elastic plates 14 of the exhaust valve member 12 are lifted to open the valve body 17. Then, the lotion is fed through the elastic plates 14 to the hollow cylindrical core 24 for guiding the lotion, and then supplied to the brush tip 23. When the pushbutton 3 is released, the return spring moves the cylinder 5 and valve rod 18 downwardly thus increasing the volume of the cylinder 5. The interior of the cylinder is evacuated in negative pressure, the suction valve 6 is thus opened to suck the lotion into the cylinder 5 in the container body 1, and the bottom cover 2 is moved upwardly by atmospheric pressure in response to the opening of the suction valve 6.

The bottom cover 2 includes two sections: a carrier 2A and a carrier holder 2B. See FIGS. 3A–3D. The carrier 2A is a cup-like element with a floor 210 and upstanding walls 220 which press against and cooperate with the interior surface of the container to seal the liquid toilet article within the container as the carrier 2A moves upwardly in response to the negative pressure in the cylinder 5. That is, when the interior of the cylinder 5 is evacuated in negative pressure, the suction valve 6 opens to suck lotion into the cylinder and draw the carrier 2A upwardly because the underside thereof communicates with the exterior of the container through the through-hole 31A. A depending post 230 extends from the bottom surface of the floor 210 centrally between the walls 220.

The carrier holder 2B is a disc-like element with an upstanding section 240 and peripheral walls 250. The upstanding section 240 includes a recess 242 which tightly receives the depending post 230 of the carrier 2A to fix the carrier 2A to the carrier holder 2B. In the assembled condition, the maximum outside diameter of the walls 220 of the carrier 2A coincide with the diameter peripheral walls 250 of the carrier holder 2B.

Figure 3A:
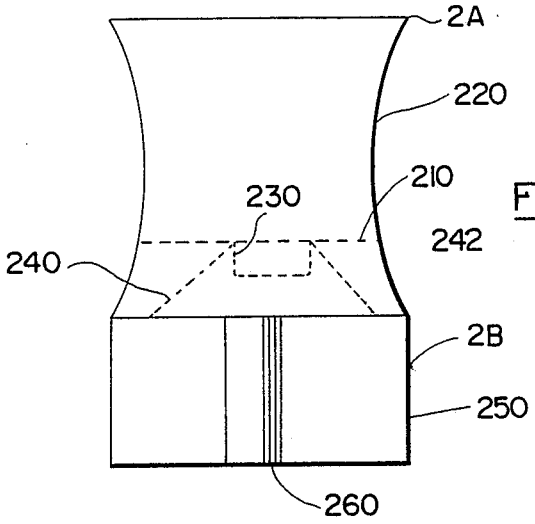
FIGS. 3A and 3B are a longitudinal sectional view of the air escape mechanism according to the invention illustrated in an assembled condition (FIG. 3A) and a disassembled condition (FIG. 3B)
Figure 3B:
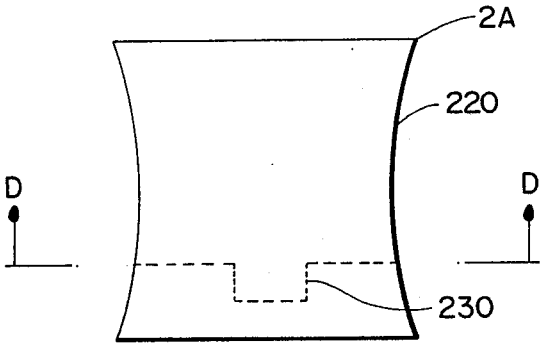
Figure 3C:
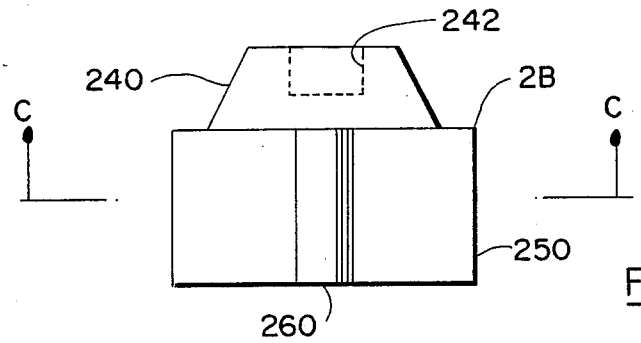
FIGS. 3C and 3D are end views of the air escape mechanism of FIG. 3B taken along the lines C—C and D—D, respectively of FIG. 3B.
Figure 3D:
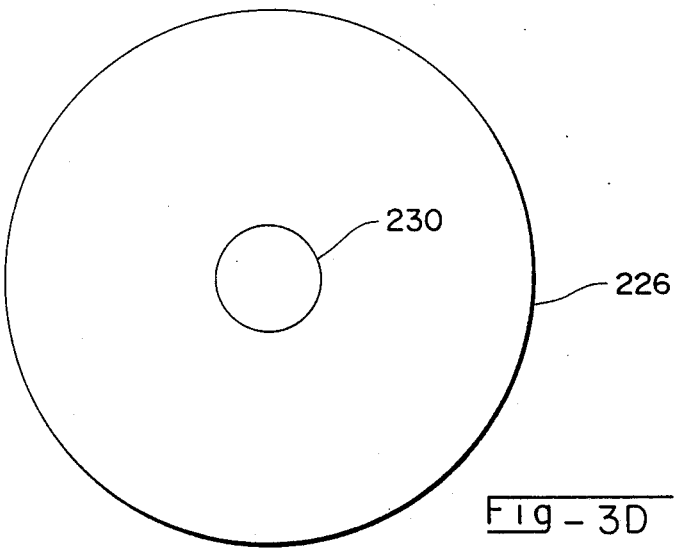
Figure 3C:
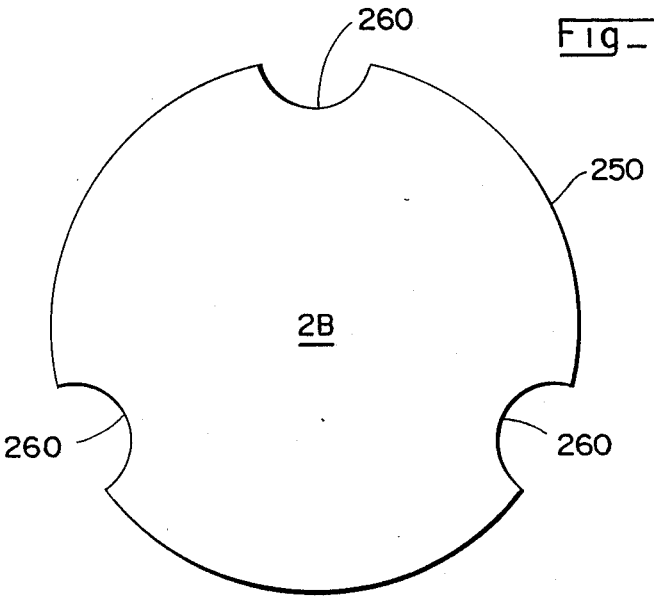

The walls 250 of the carrier holder 2B define an annular peripheral surface that presses against and cooperates with the interior surface of the container. The walls 250 have at least one air escape groove 260 which permits the escape of air trapped in the container during assembly as described below. Several grooves 260 may be utilized instead of just one groove. Preferably, the grooves are located symetrically about the longitudinal axis of the carrier holder 2B. In FIG. 3D, three grooves are provided at 120° spacing.

In filling the container, the neck 4 is closed, preferably by a threaded cap (not shown) engaging the threads 4A on the neck 4. The container is then filled with lotion from the bottom (i.e., without the bottom cover 2 or pushbutton 3 being inserted into the container). After filling the container to the level sufficient to push the carrier 2A into the lotion upon assembly of the push button 3 into the container, the carrier 2A and carrier holder 2B of the bottom cover 2 are then inserted in the assembled condition into the base of the container to seal the liquid lotion therein. This operation, however, traps air inside the container between the lotion and the bottom cover 2. The air can pass between the upstanding walls 220 of the carrier 2A and the interior walls of the container via the groove 300. To eliminate the air, the grooves 260 in the carrier holder 2B permit the trapped air to pass between the interior walls of the container and the bottom cover 2. The pushbutton 3 is then inserted into the container to force the bottom cover into the container against the lotion. This operation also permits any trapped air to escape via the grooves 260. The container is sealed from outside air when the pushbutton is secured in the first engaging groove 30 or second engaging groove 300 and thus can be supplied as a refill unit for existing implements.

The air escape grooves 260 thus permit trapped air to escape prior to sealing the container. During operation, however, the upstanding walls 220 of the carrier 2A do not permit leakage of lotion since the negative pressure is created in the cylinder 5.

To replace an empty container with a new container or refill, the external cylinder 10 is unthreaded from the threads 9A on the outer cylinder 9 of the piston 7 to expose the base of the cylinder 5. The empty container is removed from the base of the cylinder 5. The cap is removed from the neck of the refill container and the base of the cylinder is inserted into the neck of the refill container, the refill container being sealed at its base by the base cover 2 (carrier 2A and carrier holder 2B) and the push button 3. The external cylinder 10 is then rethreaded onto the outer cylinder 9 of the piston 7 to cover the container but expose the pushbutton 3 through the notch 35. The pushbutton 3 can then be depressed to move the assembly of the container 1, cylinder 5 and valve rod 18 upwardly against the return spring 100 to pressurize the lotion, and open the suction valve 6 and valve body 17 thereby supplying lotion to the tip. When the pushbutton 3 is released, the return spring 100 moves the cylinder 5 and valve 18 downwardly to increase the volume of the cylinder and create a negative pressure, thereby sucking lotion from the container 1 into the cylinder 5 and drawing the bottom cover 2 upward. Since lotion is drawn upward, the carrier 2A and carrier holder 2B of the bottom cover 2 cooperate to seal the container as they move upward. However, as described above, the carrier 2A and carrier holder 2B permit the escape of air from the container during filling and assembly of the container.

Figure 4:
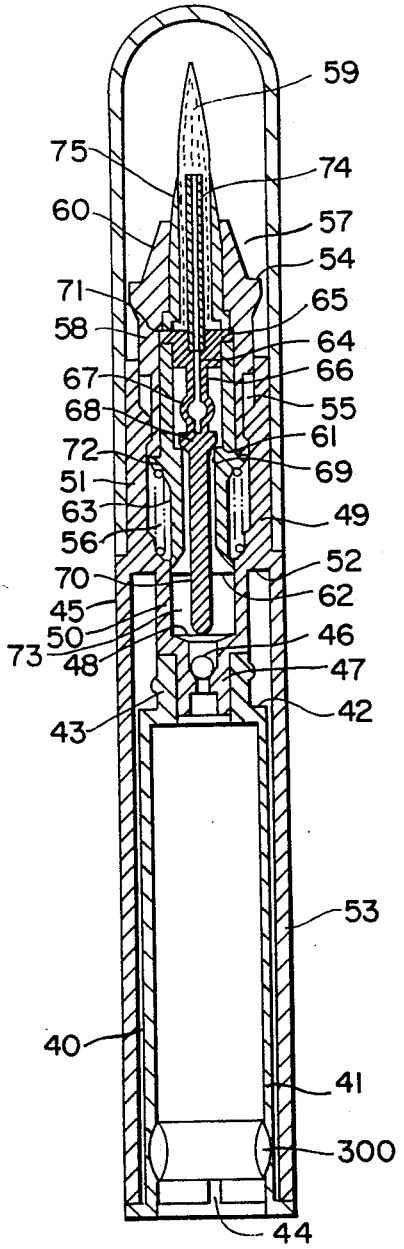
FIG. 4 is a longitudinal sectional view of a second embodiment of the invention.

FIG. 4 shows a second embodiment of the container type toilet implement according to this invention. A container 40 has a body 41 having a bottom opening and the groove 300, and a neck 43 is erected through a shoulder 42. A bottom cover 44 is engaged liquid-tightly and elevationally movably with the bottom opening of the body, and a liquid toilet article is filled in the body 41 above the cover 44. The bottom cover 44 has the same construction as the bottom cover 2 of the first embodiment to permit air escape during assembly.

Reference numeral 45 designates a column defining a cylinder on which is erected a supporting cylindrical portion 49. An outward flange 48 is placed on the top of the neck of the container to define a small cylindrical portion 47 with a suction valve 46 engaged within the neck. The lower part of the supporting cylindrical portion is formed in an engaging cylindrical portion 50 and the upper part is formed in an engaging cylindrical portion 51. The cylindrical portion 51 is formed larger in diameter than the cylindrical portion 50. A coating cylindrical portion 53 extends downwardly through an outward flange 52 from the top of the engaging cylindrical portion, and the cylindrical portion is engaged with the outer periphery of the body of the container.

A rockable cylindrical portion 55 extending from the top wall 54 is urged upwardly by a spring 56 and engaged with an operating member 57 to be elevationally movably upwardly and downwardly in the supporting cylindrical portion 49.

The operating member 57 extends from the peripheral wall 58 to the peripheral edge of the top wall 54. The operating member 57 is engaged at the center of the top wall with an upper member 60 secured to the base end of the brush tip 59, at the upper cylindrical portion within the peripheral wall 58, at the cylindrical inner surface with an upward valve seat 61, and at the lower cylindrical end with a cylindrical member 63 formed at the cylindrical piston 62. Two elastic plates 66 are extended at a predetermined interval from the lower surface of a plug 65 with a through hole 64 engaged with the top of the cylindrical member 53 in such a manner that a bent portion 67 formed at the intermediate areas of the elastic plates is formed in a ring-like shape. An exhaust valve body 68 is attached to the lower end of the elastic plates to press under pressure the valve seat 61 to form an exhaust valve 69. Also an exhaust valve member 71 has a valve rod 70 extending from the valve body.

A projecting strip 72 is formed on the outer intermediate surface of the cylindrical member 63. A coil spring 56 is movably engaged with the outer surface of the cylindrical portion below the strip 72, and engaged at the lower end with the upward step of the inner lower end of the cylindrical portion 51. Thus, when the member 60 is depressed, the piston 62 moves down in the cylinder to pressurize the interior of a pressure chamber 73 formed in the space between the suction valve 46 and the exhaust valve 68, thereby opening the exhaust valve 68 against the elasticity of the elastic plates 66 and supplying the toilet lotion to the brush tip through the hole 64 and a pipe 74 for guiding the lotion to the center of the brush tip. The valve rod 70 prevents a ball valve (forming the suction valve 46) from moving out of the valve chamber. The outer periphery of the brush tip is coated with a brush tip retaining member 75 in the same manner as the previous embodiment.

Figure 5:
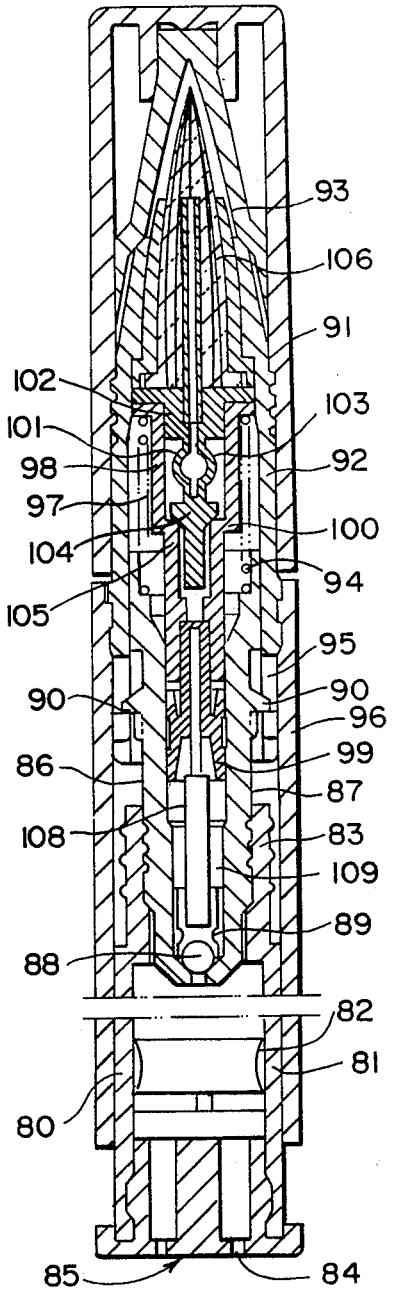
FIG. 5 is a longitudinal sectional view of a third embodiment of the invention.

FIG. 5 shows a third embodiment of the container type toilet implement according to this invention. A container 80 has a linear cylindrical body 81, and a bottom cover 82 elevationally movable in liquidtight contact at the outer periphery with the inner wall surface of the body. A neck 83 is erected through a shoulder from the body 81, and a blocking plug 85 with a throughhole 84 is engaged with the lower end of the body. The bottom cover 82 has the same construction as the bottom cover 2 of the first embodiment to permit escape of air during assembly.

A first cylindrical portion 87 projects upwardly from a cylinder 86 engaged at the lower end within the neck. A ball valve 88 is sealed in a small-diameter portion at the lower end of the first cylindrical portion 87, and a suction valve 89 is formed from the small-diameter portion and the ball valve. Connectors 90 project from both right and left sides of the intermediate portion of the cylinder.

A brush tip shaft 91 is erected upward at the brush tip 93 from the top of a second cylindrical portion 92, and the top of the cylinder is engaged to be elevationally movable by a spring 94 in the cylindrical portion 92. Through holes 95 are provided longitudinally with the connectors 90 in the cylindrical portion 92. An outer cylinder 96 engaged slidably with the outer surface of the body of the container is engaged at the upper end with the lower outer surface of the second cylindrical portion 92.

A member 97 with a piston is secured at the upper end to the upper inner surface of the second cylindrical portion of the brush tip shaft and has a third cylindrical portion 98. A cylindrical piston 99 is attached to the lower end of the third cylindrical portion, and an inward flange valve seat 100 is formed on the inner surface of the third cylindrical portion.

A member 101 with a valve body is secured at the upper cylindrical end 102 to the top inner surface of the second cylindrical portion 92 or the third cylindrical portion 98. The valve 101 includes a pair of right and left arcuate elastic plates 103. A valve body 104 attached to the lower portion of the elastic plates is contacted under pressure with the valve seat 100 to form an exhaust valve 105. A pipe 106 guides liquid toilet article or lotion in the upper cylindrical end 102, and the pipe 106 is extended at the end to the intermediate area of the upper and lower ends of the axial core of the brush tip 93.

A rod member 108 is internally mounted in the cylinder 86 to increase the compression ratio in a pressurizing chamber formed between the valves 89 and 105. The member 108 projects toward a spacer 109 extending from the lower outer surface of the rod portion so that the end of the spacer is contacted under pressure with the lower inner wall of the cylinder. The rod portion is disposed at the lower end above the ball valve 88 to prevent the ball valve from moving out of the valve chamber.

Further, the upper half of the rod is inserted elevationally movably at the upper portion as a small-outer diameter portion into the member with a piston. The rod member is operated to lift the valve body at the upper end of the rod portion only when the container is lifted to the upper limit with respect to the brush tip shaft to open the exhaust valve by the lifting.

According to this invention as described above, the container type toilet implement comprises the cylinder and piston mechanism, thereby supplying liquid toilet article or lotion in the container to the brush tip by the operation of the mechanism. Thus, the toilet implement does not form droplets of toilet lotion on the tip or excessively impregnate the tip as in the conventional toilet implement which dips the brush tip directly in the toilet lotion. Further, since the toilet implement of this invention comprises the exhaust valve, it does not leak the lotion even if the implement is tilted or overturned. Moreover, the two part construction of the bottom cover with air escape grooves permits the removal of air from the lotion during assembly of the container, thereby inhibiting formation of air bubbles in the lotion or passage of air bubbles through the piston mechanism.

What is claimed is:

1. A container type toilet implement for selectively dispersing lotion through a tip, comprising:

a container having lotion therein and defining upper and lower portions, the lower portion of the container including at least one groove on an inner surface of the container;

an operating mechanism connected to the upper portion of said container for selectively drawing lotion from said container to said tip;

a bottom cover elevationally movable toward said upper portion in response to lotion being drawn from said container to said tip by said operating mechanism, said bottom cover liquid-tightly sealing the lower portion of the container when positioned between the at least one groove and the operating mechanism;

said bottom cover including air escape means cooperating with said at least one groove for eliminating air trapped in said container between said lotion and said bottom cover as the bottom cover moves past said at least one groove.

2. The implement of claim 1, wherein said bottom cover includes a peripheral wall pressed against an inner surface of the container.

3. The implement of claim 2, wherein said air escape means includes at least one groove formed in the peripheral wall of the bottom cover.

4. The implement of claim 3, wherein three grooves are provided in the peripheral wall of the bottom cover.

5. The implement of claim 4, wherein the grooves are symetrically spaced at 120° intervals.

6. The implement of claim 1, wherein said bottom cover includes a carrier and a carrier holder, the carrier having peripheral walls contacting an internal surface of said container to seal the lotion within the container, the carrier holder having peripheral walls with said air escape means.

7. The implement of claim 6, wherein said air escape means includes at least one groove formed in the peripheral wall of said carrier holder.

8. The implement of claim 6, wherein said carrier and carrier holder are attached by a releasable securing mechanism.

9. The implement of claim 8, wherein said detachable securing mechanism includes a post in one of said carrier and said carrier holder, and a recess in the other of said carrier and carrier holder, said recess receiving said post to secure said carrier to said carrier holder.

10. A container type toilet implement for selectively dispersing lotion comprising:

a container body having lotion therein and defining upper and lower portions, the lower portion of the container including at least one groove on an inner surface of the container, a neck of the container body having located in the upper portion of the container body;

an external cylinder surrounding an outer periphery of said container body;

a bottom cover elevationally movable toward said upper portion, said bottom cover liquid-tightly sealing the lower portion of the container when positioned between the at least one groove and the neck;

an upwardly extending cylinder erected at the neck of said container body;

a suction valve mounted in a lower portion of said cylinder;

a piston engaged at a lower portion thereof with an upper inner surface of said cylinder and disposed slidably and telescopically in said cylinder, said piston having a top portion opposite said lower portion;

a spring member disposed between said cylinder and said piston for urging said cylinder downwardly;

an exhaust valve member having two elastic plates extending downwardly at a predetermined interval from an upper end cylindrical portion formed in said piston, said elastic plates having opposed bent parts in a ring shape substantially at an intermediate area thereof;

a rod valve disposed in said cylinder below said exhaust valve member and spaced therefrom, said rod valve extending at a lower end thereof to the lower portion of said cylinder;

an exhaust valve body formed at a lower portion of the elastic plates of said exhaust valve member and a valve seat formed at a central inner surface of said piston;

a sealing mechanism for sealing the interior of said cylinder;

a brush tip disposed above said exhaust valve member and supplied with a toilet article through said exhaust valve member;

said piston being secured directly or indirectly to the outer cylinder on the outer periphery of said container body, and said exhaust valve member being secured to the top portion of said piston; and said bottom cover including air escape means cooperating with said at least one groove for eliminating air trapped in said container body between said lotion and said bottom cover as said bottom cover moves past said at least one groove.

11. The implement of claim 10 wherein said bottom cover includes a carrier and a carrier holder, the carrier having peripheral walls contacting an internal surface of said container to seal the lotion within the container, the carrier holder having peripheral walls with said air escape means.

12. The implement of claim 11 wherein said air escape means includes at least one groove formed in the peripheral wall of said carrier holder.

13. The implement of claim 10 further comprising a pushbutton for air tightly sealing said container, said bottom cover being located between said lotion and said pushbutton such that trapped air escapes via said air escape means prior to sealing said container with said pushbutton.

14. The implement of claim 13 wherein said pushbutton presses said container body and cylinder toward said piston against said spring member.

* * * * *